US007316081B1

(12) United States Patent
Cheng

(10) Patent No.: US 7,316,081 B1
(45) Date of Patent: Jan. 8, 2008

(54) AIR CIRCULATING SHOE PAD

(76) Inventor: Kan Cheng, 6163A Joaquin Murieta, Newark, CA (US) 94560

( * ) Notice: Subject to any disclaimer, the term of this patent is extended or adjusted under 35 U.S.C. 154(b) by 562 days.

(21) Appl. No.: 10/909,676

(22) Filed: Aug. 2, 2004

(51) Int. Cl.
*A43B 7/06* (2006.01)
*A43B 13/20* (2006.01)
*A43B 21/28* (2006.01)

(52) U.S. Cl. ..... 36/3 R; 36/3 B; 36/29

(58) Field of Classification Search ..... 36/3 A, 36/3 B, 3 R, 29, 35 B, 141
See application file for complete search history.

(56) References Cited

U.S. PATENT DOCUMENTS

| | | | | |
|---|---|---|---|---|
| 220,475 | A | 10/1879 | Hannaford | |
| 592,822 | A | 11/1897 | Parker | |
| 2,474,815 | A | 7/1949 | Brahm | |
| 3,417,494 | A * | 12/1968 | Claff | 36/3 B |
| 3,475,836 | A | 11/1969 | Brahm | |
| 5,375,345 | A * | 12/1994 | Djuric | 36/3 B |
| 5,655,314 | A * | 8/1997 | Petracci | 36/3 B |
| 5,826,349 | A * | 10/1998 | Goss | 36/3 R |
| 6,041,519 | A | 3/2000 | Cheng | |
| 6,553,690 | B2 * | 4/2003 | Di Girolamo | 36/3 R |
| 6,581,303 | B1 * | 6/2003 | Tuan | 36/3 B |
| 6,671,979 | B2 | 1/2004 | Cardarelli | |
| 2002/0066207 | A1 | 6/2002 | Cheng | |
| 2004/0078996 | A1 | 4/2004 | Brooks | |
| 2004/0163277 | A1 * | 8/2004 | Saiz Zapata | 36/3 B |

* cited by examiner

*Primary Examiner*—Jila M Mohandesi
(74) *Attorney, Agent, or Firm*—Jack Lo

(57) ABSTRACT

A shoe pad includes air pumping elements for cooling the interior of a shoe. The pumping elements include forward pumping elements for pumping air from back to front, and backward pumping elements for pumping air from front to back. The pad includes an upper sheet attached to a lower sheet. Each pumping element includes a channel on the lower sheet covered by the upper sheet. The channel has an intake and an exhaust. Cavities are distributed along the channel. Resilient blisters on the upper sheet are aligned with the cavities on the lower sheet to define pumps. Each pump has an intake and an exhaust. Flap valves projecting down from the upper sheet are respectively positioned against the intakes of the pumps. Alignment pins projecting down from the top sheet are positioned in alignment holes on the lower sheet.

10 Claims, 4 Drawing Sheets

AIR CIRCULATING SHOE PAD

BACKGROUND OF THE INVENTION

1. Field of the Invention

The invention broadly relates to devices for circulating air inside shoes.

2. Prior Art

A shoe worn in warm weather is hot, humid and uncomfortable. Therefore, many devices for circulating air inside a shoe have been invented. U.S. Pat. No. 6,671,979 discloses a pump connected to air channels for recirculating air drawn in through an intake, but there is no exhaust port for expelling the hot air. U.S. Pat. No. 220,475 discloses a shoe cooled by air channels with a port adjacent the heel and another port in the sole, but has no pump for moving air through the channels. US published patent application 2004/0078996 discloses a shoe with resilient tubes in the sole open to opposite edges of the sole, but the tubes have no valve for directing airflow. U.S. Pat. No. 2,474,815 discloses a shoe pad with an intake and a discharge valve feeding a manifold, but there is no apparent connection between the valves. U.S. Pat. Nos. 6,041,519 and 3,475,836, and published patent application 2002/0066207 each disclose a shoe pad with a pump with a single valve feeding a manifold. U.S. Pat. No. 592,822 disclose a ventilated sole with an intake aperture, but the aperture is not a valve and there is no pump. U.S. Pat. No. 5,655,314 to Petracci discloses a shoe with a pump on the insole and a one way valve for sucking air from inside the shoe and exhausting it from the back of the heel. A specially made sole is required.

BRIEF SUMMARY OF THE INVENTION

An air circulating shoe pad includes a plurality of air pumping elements for cooling the interior of a shoe. The pumping elements comprise forward pumping elements for pumping air from back to front, and backward pumping elements for pumping air from front to back. The pad is comprised of an upper sheet attached to a lower sheet. Each pumping element is comprised of a channel on the lower sheet covered by the upper sheet. The channel has an intake and an exhaust. Cavities are distributed along the channel. Resilient blisters on the upper sheet are aligned with the cavities on the lower sheet to define pumps. Each pump has an intake and an exhaust. Flap valves projecting down from the upper sheet are respectively positioned against the intakes of the pumps. Alignment pins projecting down from the top sheet are positioned in alignment holes on the lower sheet.

DRAWING REFERENCE NUMERALS

Figure 1:
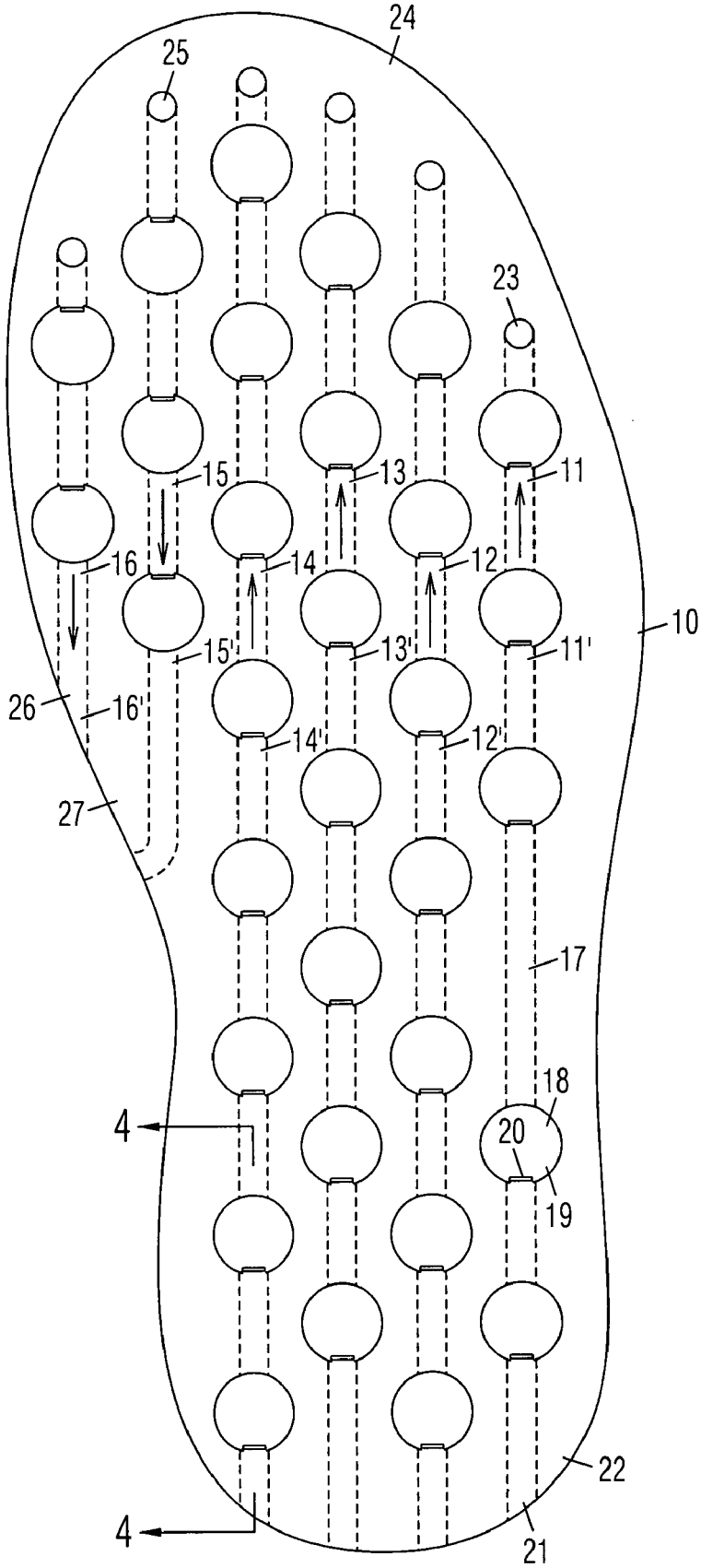
FIG. 1 is a top view of an air circulating shoe pad.

| | |
|---|---|
| 10. Shoe Pad | 11. Pumping Element |
| 11'. Forward Pumping Element | 12. Pumping Element |
| 12'. Forward Pumping Element | 13. Pumping Element |
| 13'. Forward Pumping Element | 14. Pumping Element |
| 14'. Forward Pumping Element | 15. Pumping Element |
| 15'. Backward Pumping Element | 16. Pumping Element |
| 16'. Backward Pumping Element | 17. Channel |
| 18. Pump | 19. Blister |
| 20. Flap Valve | 21. Intake |
| 22. Heel Portion | 23. Exhaust |
| 24. Toe Portion | 25. Intake |
| 26. Exhaust | 27. Mid Portion |
| 28. Shoe Pad | 29. Pumping Element |
| 30. Pumping Element | 31. Medication Pocket |
| 32. Upper Sheet | 33. Lower Sheet |
| 34. Cavity | 35. Blister |
| 36. Spring | 37. Alignment Pin |
| 38. Alignment Hole | 39. Intake |
| 40. Exhaust | 41. Shoe |
| 42. Arrow | 43. Foot Opening |
| 44. Toe Portion | 45. Arrow |
| 46. Arrow | 47. Hole |
| 48. Arrow | 49. Arrow |
| 50. Hole | |

DETAILED DESCRIPTION OF THE INVENTION

FIG. 1

An air circulating shoe pad 10 includes a plurality of air pumping elements 11-16 for cooling the interior of a shoe. Each pumping element is comprised of a longitudinal internal channel 17 with a plurality of pumps 18 arranged in a series along channel 17. Each pump 18 is comprised of a resilient blister 19 on top of pad 10, and a one-way flap valve 20. Each pumping element may have more or fewer pumps than shown. The pumping power of the series connected pumps are combined for increasing air flow. Pumping elements 11-16 are separate from each other.

As indicated by the air flow direction arrows, pumping elements 11-14 include forward pumping elements 11'-14' which pump air from back to front, and rearward pumping elements 15'-16' which pump air from front to back. Forward pumping elements 11'-14' have intakes 21 adjacent a heel portion 22 of pad 10 and exhausts 23 adjacent a toe portion 24 of pad 10. Rearward pumping elements 15'-16' have intakes 25 adjacent toe portion 24 and exhausts 26 adjacent a mid portion 27 of pad 10. Alternatively, the intakes and exhausts may have different positions than shown. For example, rearward pumping elements 15'-16' may have exhausts adjacent heel portion 22.

FIG. 2

Figure 2:
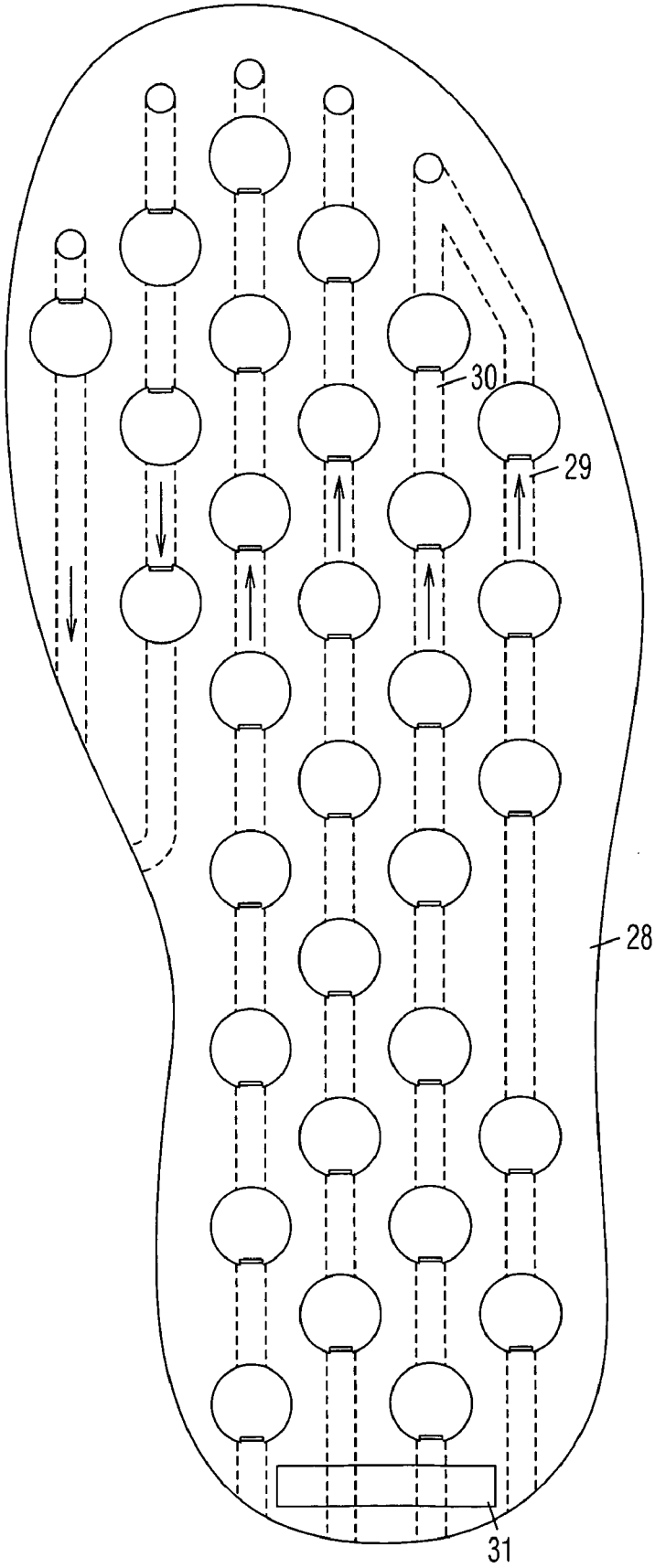
FIG. 2 is a top view of another embodiment thereof.

An alternative shoe pad 28 shown in FIG. 2 includes some pumping elements 29 and 30 which are connected to each other. Also, a medication pocket 31 is provided on pad 28 for dispersing a foot medication by air circulation.

FIG. 3

Figure 3:
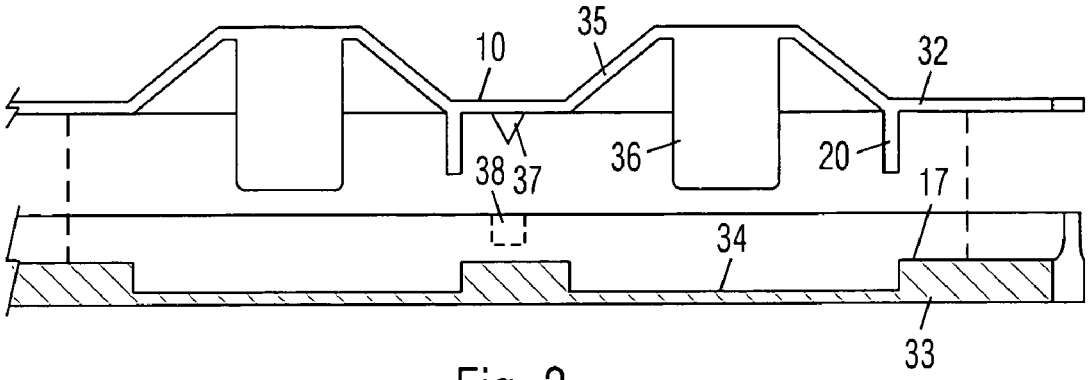
FIG. 3 is an exploded sectional view of the shoe pad.

In the longitudinal sectional exploded view of FIG. 3, pad 10 is comprised of an upper sheet 32 attached to a lower sheet 33. Channel 17 is arranged on lower sheet 33. Cavities 34 are distributed along channel 17. Convex blisters 35 are arranged on upper sheet 32 in alignment with cavities 34 on lower sheet 33. Springs 36 are connected to the bottoms of respective blisters 35. Flexible one-way flap valves 20 project down from upper sheet 32 in alignment with cavities 34. Alignment pins 37 projecting down from upper sheet 32 are aligned with alignment holes 38 on lower sheet 33. Blisters 35, flap valves 20, and alignment pins 37 are preferably integrally formed on upper sheet 32 from a single material.

FIG. 4

Figure 4:
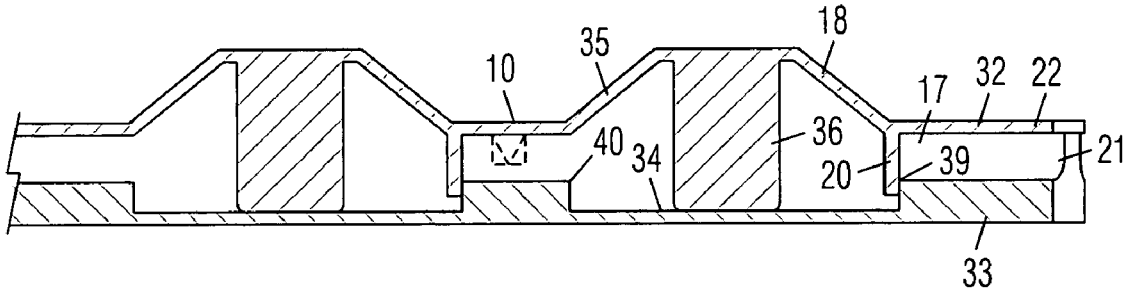
FIG. 4 is a sectional view of the shoe pad taken along line 4-4 in FIG. 1 in a relaxed condition.

Upper sheet 32 and lower sheet 33 are shown assembled in FIG. 4. Channel 17 on lower sheet 33 is covered by upper sheet 32. Intake 21 of channel 17 is at the edge of heel portion 22. Blisters 35 on upper sheet 32 are aligned with cavities 34 on lower sheet 33 to define pumps 18. Each pump 18 has an intake 39 and an exhaust 40. Flexible flap valves 20 are respectively positioned against intakes 39. Springs 36 under blisters 35 are respectively positioned in cavities 34.

FIGS. 5-6

Figure 5:
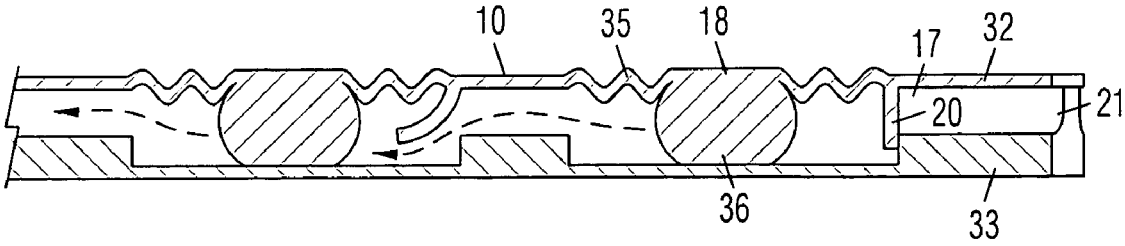
FIG. 5 shows the pumps of the pad compressed and exhausting air.
Figure 6:
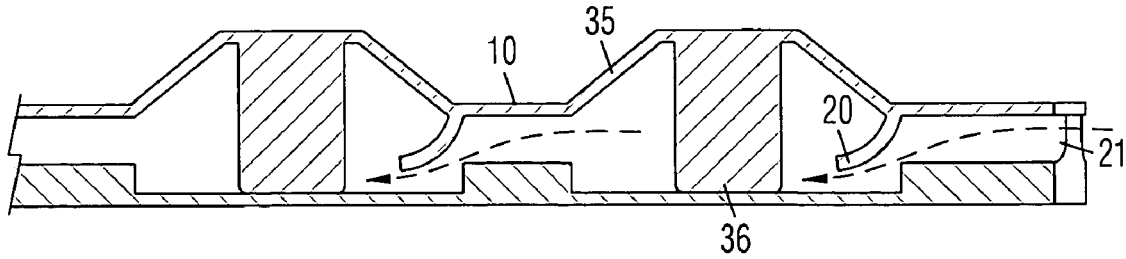
FIG. 6 shows the pumps expanded and drawing in air.

The operation of pad 10 is shown in FIGS. 5-6. In FIG. 5, blisters 35 of pumps 18 are compressed against springs 36 when the wearer puts weight on pad 10, such as during the downstroke of a step. The flap valve in the first pump at an upstream end of each pumping element is closed by the increased air pressure inside pump 18. The flap valves downstream from the first pump are opened by pressure differential between the upstream and downstream ends of the pumping element. Therefore, air is moved from intake 21 towards the exhaust.

In FIG. 6, blisters 35 are relaxed and returned into their original shape when weight is lifted from pad 10, such as during an upstroke of a step. Blisters 35 are pushed back to their extended positions by springs 36. The flap valve at the first pump at the upstream end of the pumping element is opened to drawn in air from intake 21 due to the lower pressure inside the pump than the outside environment. The flap valve at the last pump at the downstream end of the pumping element is closed due to the lower pressure upstream.

FIG. 7

Figure 7:
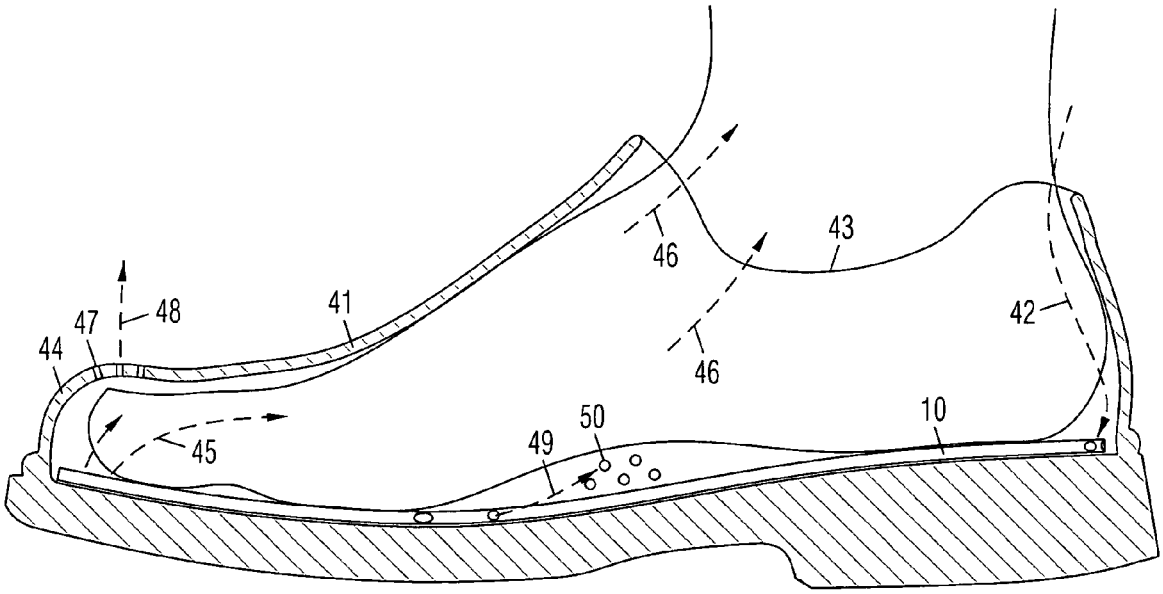
FIG. 7 is a sectional view of a shoe with the pad showing the air circulation pattern.

A sectional view of a shoe 41 with pad 10 inside is shown in FIG. 7. Pad 10 may be provided either as an add-on accessory or a built-in part of the insole. Cool air indicated by arrow 42 is drawn in from the outside environment through a foot opening 43 of shoe 41 by the forward pumping elements. The cool air is exhausted into a toe portion 44 as indicated by arrow 45 to cool the hot interior of the shoe. Some air is expelled from the shoe through holes 47 at a toe portion 44 as indicated by arrow 48. Hot air is actively pumped from the hot toe end of the shoe by the rearward pumping elements and expelled from the shoe through holes 50 on the side of the shoe as indicated by arrow 49. Hot air inside the shoe is also expelled from foot opening 43 by the air flow generated by the combined exhaust from the forward and rearward pumping elements, as indicated by arrows 46.

Although the foregoing description is specific, it should not be considered as a limitation on the scope of the invention, but only as an example of the preferred embodiment. Many variations are possible within the teachings of the invention. Therefore, the scope of the invention should be determined by the appended claims and their legal equivalents, not by the examples given.

I claim:

1. An air circulating shoe pad for being positioned inside a shoe, comprising:

a plurality of air pumping elements for cooling an interior of said shoe, wherein said pumping elements include forward pumping elements arranged to pump air in a forward direction, and rearward pumping elements arranged to pump air in a backward direction, said forward pumping elements and said rearward pumping elements cooperate to provide bi-directional air circulation;

wherein said pumping elements are defined by an upper sheet attached to a lower sheet, said lower sheet includes a plurality of channels and a plurality of cavities along each of said channels, and said upper sheet includes a plurality of convex blisters and one way valves adjacent respective blisters, wherein a plurality of pumps along each of said channels are defined by said cavities being covered by said blisters and said valves being positioned in said cavities.

2. An air circulating shoe pad for being positioned inside a shoe, comprising:

a plurality of air pumping elements for cooling an interior of said shoe, wherein said pumping elements include forward pumping elements arranged to pump air in a forward direction, and rearward pumping elements arranged to pump air in a backward direction, said forward pumping elements and said rearward pumping elements cooperate to provide bi-directional air circulation; and springs under respective blisters to return said blisters to an up position after being depressed.

3. An air circulating shoe pad for being positioned inside a shoe, comprising:

a plurality of air pumping elements for cooling an interior of said shoe, wherein said pumping elements include forward pumping elements arranged to pump air in a forward direction, and rearward pumping elements arranged to pump air in a backward direction, said forward pumping elements and said rearward pumping elements cooperate to provide bi-directional air circulation;

wherein said forward pumping elements include intakes adjacent a heel portion of said pad and exhausts adjacent a toe portion of said pad, and said rearward pumping elements include intakes adjacent said toe portion of said pad and exhausts adjacent a mid portion of pad.

4. An air circulating shoe pad for being positioned inside a shoe, comprising:

a plurality of air pumping elements for cooling an interior of said shoe, wherein said pumping elements include forward pumping elements arranged to pump air in a forward direction, and rearward pumping elements arranged to pump air in a backward direction, said forward pumping elements and said rearward pumping elements cooperate to provide bi-directional air circulation;

wherein each of said pumping elements is comprised of a longitudinal internal channel with a plurality of pumps arranged in a series along said channel to increase pumping power and provide redundancy in case of pump failure;

wherein said forward pumping elements include intakes adjacent a heel portion of said pad and exhausts adjacent a toe portion of said pad, and said rearward pumping elements include intakes adjacent said toe portion of said pad and exhausts adjacent a mid portion of pad.

5. An air circulating shoe pad for being positioned inside a shoe, comprising:

a plurality of air pumping elements for cooling an interior of said shoe, wherein said pumping elements include forward pumping elements arranged to pump air in a forward direction, and rearward pumping elements arranged to pump air in a backward direction, said forward pumping elements and said rearward pumping elements cooperate to provide bi-directional air circulation;

wherein each of said pumping elements is comprised of a longitudinal internal channel with a plurality of pumps arranged in a series along said channel to increase pumping power and provide redundancy in case of pump failure;

wherein each of said pumps is comprised of a convex blister on top of a cavity, and a spring under said blister to return said blister to an up position after being depressed.

6. An air circulating shoe pad for being positioned inside a shoe, comprising:

a plurality of air pumping elements for cooling an interior of said shoe, wherein said pumping elements include forward pumping elements arranged to pump air in a forward direction, and rearward pumping elements arranged to pump air in a backward direction, said forward pumping elements and said rearward pumping elements cooperate to provide bi-directional air circulation;

wherein each of said pumping elements is comprised of a longitudinal internal channel with a plurality of pumps arranged in a series along said channel to increase pumping power and provide redundancy in case of pump failure;

wherein said pad is comprised of an upper sheet attached to a lower sheet, said lower sheet includes said channel and a plurality of cavities along said channel, said upper sheet includes a plurality of convex blisters and one way valves adjacent respective blisters, said pumps are defined by said cavities being covered by said blisters and said one way valves being positioned in said cavities.

7. The air circulating shoe pad of claim 6, wherein said forward pumping elements include intakes adjacent a heel portion of said pad and exhausts adjacent a toe portion of said pad, and said rearward pumping elements include intakes adjacent said toe portion of said pad and exhausts adjacent a mid portion of pad.

8. The air circulating shoe pad of claim 6, wherein a plurality of said pumping elements are connected to each other.

9. The air circulating shoe pad of claim 6, further including a medication pocket on said pad for receiving and dispersing a foot medication by said air circulation.

10. The air circulating shoe pad of claim 6, further including springs under said blisters to return said blisters to an up position after being depressed.

* * * * *